US011071376B2

(12) United States Patent
Leng

(10) Patent No.: US 11,071,376 B2
(45) Date of Patent: Jul. 27, 2021

(54) FOLDING INTEGRATED TABLE AND BENCH

(71) Applicant: New-Tec Integration (Xiamen) Co., Ltd., Xiamen (CN)

(72) Inventor: Luhao Leng, Xiamen (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 0 days.

(21) Appl. No.: 16/780,873

(22) Filed: Feb. 3, 2020

(65) Prior Publication Data

US 2020/0170401 A1 Jun. 4, 2020

Related U.S. Application Data

(63) Continuation of application No. PCT/CN2018/098211, filed on Aug. 2, 2018.

(30) Foreign Application Priority Data

Aug. 3, 2017 (CN) ..... 201720963053.2

(51) Int. Cl.
*A47B 3/14* (2006.01)
*A47B 83/02* (2006.01)
*A47B 3/02* (2006.01)

(52) U.S. Cl.
CPC ..... *A47B 3/14* (2013.01); *A47B 3/02* (2013.01); *A47B 83/024* (2017.08); *A47B 2003/145* (2013.01)

(58) Field of Classification Search
CPC ... A47B 83/024; A47B 2003/145; A47B 3/14; A47B 83/021; A47B 83/0213; A47B 83/0215; A47B 3/02
See application file for complete search history.

(56) References Cited

U.S. PATENT DOCUMENTS 2,568,622 A * 9/1951 Hagan ..... A47B 3/14
297/158.4
2,825,390 A * 3/1958 Post ..... A47B 3/14
297/139

(Continued)

FOREIGN PATENT DOCUMENTS

CN 2762632 Y 3/2006
CN 2764224 Y 3/2006

(Continued)

OTHER PUBLICATIONS

International Search Report and Written Opinion with English Translation of ISR, cited in PCT/CN2018/098211 dated Dec. 14, 2018, 10 pages.

*Primary Examiner* — Milton Nelson, Jr.
(74) *Attorney, Agent, or Firm* — Cooper Legal Group, LLC

(57) ABSTRACT

The present disclosure discloses a folding integrated table and bench comprising a front table board, a front bench board, a bracket, and two front legs. The front table board is pivotally connected to the bracket and is configured to be rotated relative to the bracket. Each of the two front legs comprises a first upper cross rod, a first vertical rod, a first lower cross rod, and a first standing rod connected in sequence. A top end of the first standing rod comprises a first connecting shaft, and the first vertical rod is rotatably connected to the bracket so that each of the two front legs is configured to be rotated to be folded and unfolded. A bottom surface of the front bench board is symmetrically disposed with two first sliding grooves.

8 Claims, 8 Drawing Sheets

(56) References Cited

U.S. PATENT DOCUMENTS

| | | | | | |
|---|---|---|---|---|---|
| 3,174,796 | A * | 3/1965 | Brown | A47B 3/14 | 297/158.4 |
| 3,885,829 | A * | 5/1975 | Haeger | A47B 3/14 | 297/158.4 |
| 5,352,015 | A * | 10/1994 | Morgan | A47B 3/04 | 297/463.1 |
| 7,735,915 | B2 | 6/2010 | Nye et al. | | |
| 10,351,036 | B2 * | 7/2019 | Foohey | B60N 3/002 | |

FOREIGN PATENT DOCUMENTS

| | | | |
|---|---|---|---|
| CN | 201205076 | Y | 3/2009 |
| CN | 101669723 | A | 3/2010 |
| CN | 203407686 | U | 1/2014 |
| CN | 203986921 | U | 12/2014 |
| KR | 20130019094 | A | 2/2013 |

* cited by examiner

FOLDING INTEGRATED TABLE AND BENCH

RELATED APPLICATIONS

This application is a continuation of and claims priority to PCT Patent Application PCT/CN2018/098211, filed on Aug. 2, 2018, which claims priority to Chinese Patent Application 201720963053.2, filed on Aug. 3, 2017. PCT Patent Application PCT/CN2018/098211 and Chinese Patent Application 201720963053.2 are incorporated herein by reference.

FIELD OF THE DISCLOSURE

The present disclosure relates to a folding integrated table and bench.

BACKGROUND OF THE DISCLOSURE

A folding table and a folding bench (a folding chair) can be folded to reduce storage space, and they are easy to be transported in a folded state. Therefore, people like to bring the folding table and the folding bench when he(she) is outdoors.

The folding table and the folding bench can be used in combination, but they are independent products. When the folding table and the folding bench are unfolded and folded, they are operated separately without any connection. Therefore, although existing folding tables and folding benches can be unfolded and be folded, they are operated separately, and they are not very convenient to use. The structure of existing folding integrated tables and benches are firm, but they are not easy to fold.

BRIEF SUMMARY OF THE DISCLOSURE

The present disclosure provides a folding integrated table and bench to solve deficiencies of the background techniques. In order to solve the aforementioned technical problems, a technical solution of the present disclosure is as follows.

A folding integrated table and bench comprises a front table board, a front bench board, a bracket and two front legs. The two front legs are symmetrically arranged on a left side and a right side of the bracket, and the front table board is pivotally connected to the bracket and is configured to be rotated relative to the bracket. Each of the two front legs comprises a first upper cross rod, a first vertical rod, a first lower cross rod, and a first standing rod. A top of the first standing rod comprises a first connecting shaft, and the first vertical rod is rotatably connected to the bracket so that each of the two front legs is configured to be rotated to be folded and unfolded. A bottom surface of the front bench board is symmetrically disposed with two first sliding grooves. Each of the two first sliding groove is arc shaped, and the first connecting shaft of the two front legs is slidably disposed in a corresponding one of the two sliding grooves. When the folding integrated table and bench is in an unfolded state, the front table board and the front bench board are horizontally placed, the first connecting shaft of each of the two front legs is disposed at an outer end of the corresponding one of the two first sliding grooves, the first connecting shaft of each of the two front legs support the front bench board, and the first upper cross rod of each of the two front legs supports the front table board. When the folding integrated table and bench is in a folded state, the first connecting shaft of each of the two front legs is disposed at an inner end of the corresponding one of the two first sliding grooves so that the first connecting shaft of each of the two front legs is rotatably connected to the front bench board, the front bench board is configured to be turned down to a vertical position, the first upper cross rod of each of the two front legs provides space to the front table board, and the front table board is configured to be turned down to the vertical position.

Compared with the background art, this technical solution has the following advantages:

In the unfolded state, the two front legs are unfolded and the first connecting shafts support the horizontally placed front bench board, while the first upper cross rods support the horizontally placed front table board. In the folded state, the two front legs are folded and the first connecting shafts are rotatably connected to the front bench board, enabling the front bench board to be turned down to a vertical position around the first connection shafts. At the same time, the first upper cross rods provide space to the front table board to enable the front table board to be turned down to a vertical position. The folding integrated table and bench of the present disclosure provides that the front table board and the front bench board can be folded and unfolded synchronously by operating the two front legs, which is more convenient to use.

BRIEF DESCRIPTION OF THE DRAWING

The present disclosure will be further described below with the combination with the accompanying drawings and the embodiments.

DETAILED DESCRIPTION OF THE EMBODIMENTS

Embodiment 1

Figure 1:
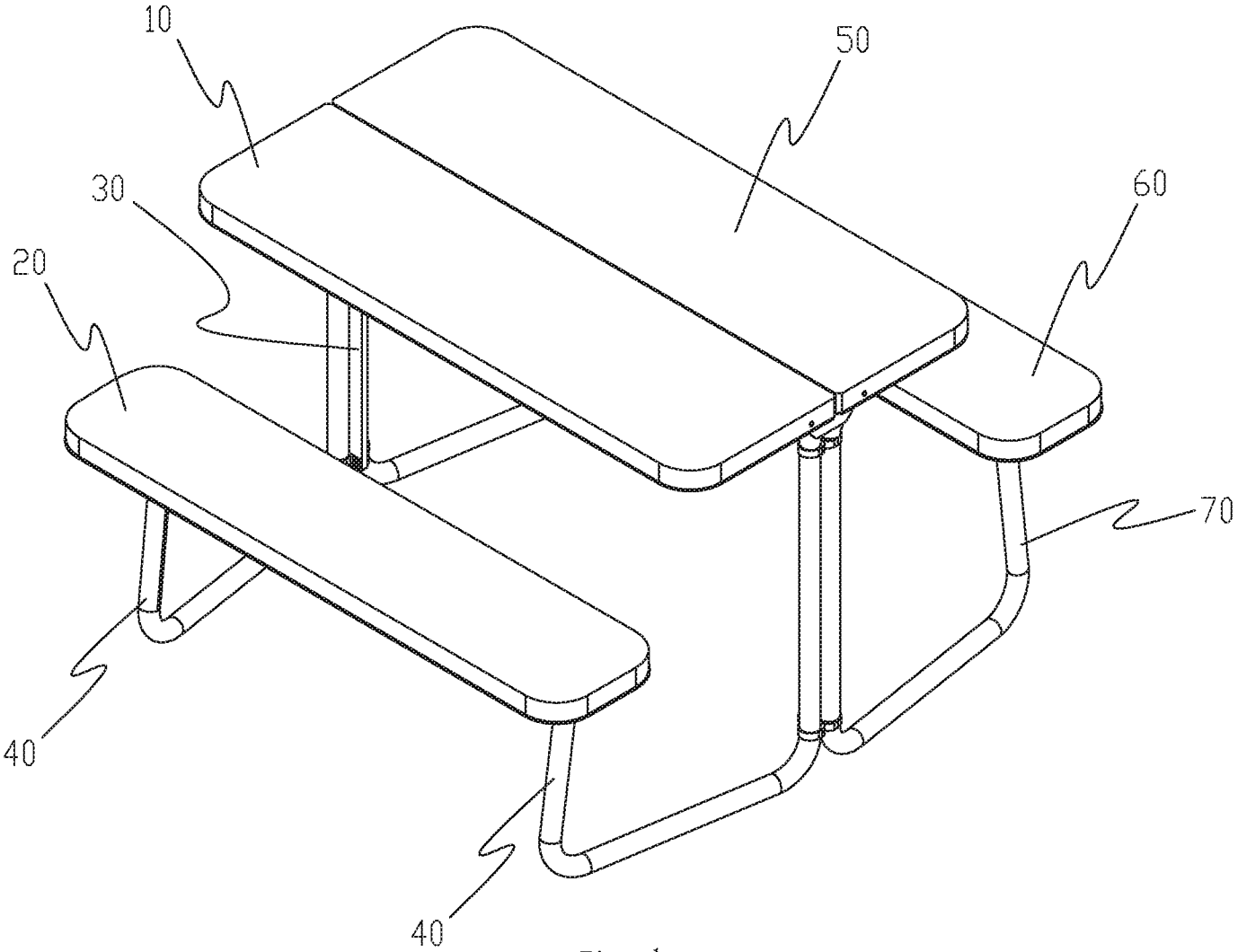
FIG. 1 illustrates a schematic view of a folding integrated table and bench of Embodiment 1 of the present disclosure in an unfolded state.
Figure 2:
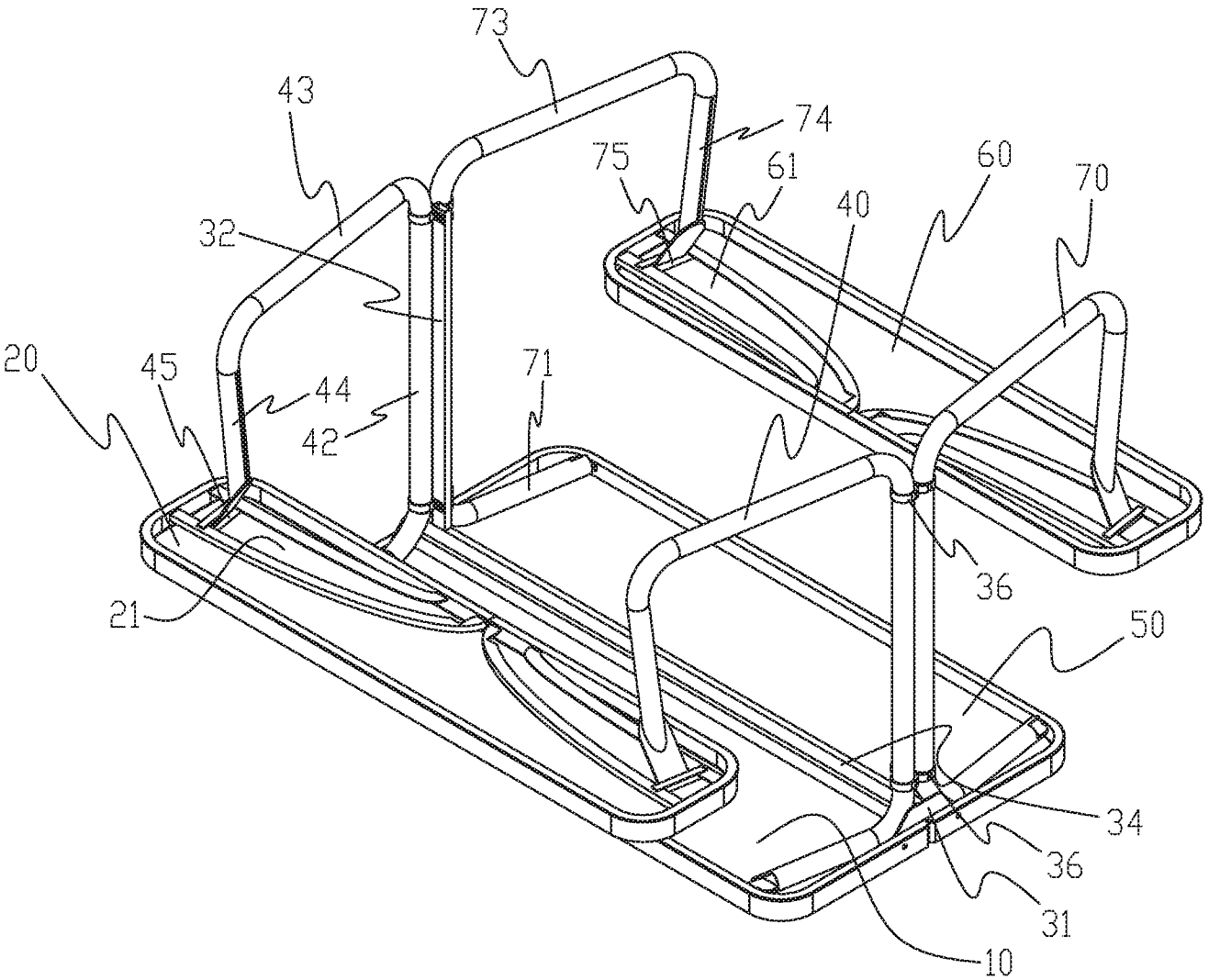
FIG. 2 illustrates another schematic view of the folding integrated table and bench of Embodiment 1 of the present disclosure in a folded state.

Referring to FIGS. 1-6, a folding integrated table and bench of the present disclosure comprises a front table board 10, a front bench board 20, a bracket 30, and two front legs 40. The front table board 10 is pivotally connected to the bracket 30 and is configured to be rotated relative to the bracket 30, and the two front legs 40 are symmetrically disposed on left and right sides of the bracket 30. The two front legs 40 are configured to be rotated to be unfolded and folded. When the two front legs 40 are unfolded, the front table board 10 and the front bench board 20 are supported simultaneously by the two front legs 40. When the two front legs 40 are folded, the front table board 10 is rotated about the bracket 30, and the front bench board 20 is rotated about the two front legs 40.

Each of the two front legs 40 comprises a frame structure with an opening, which comprises a first upper cross rod 41, a first vertical rod 42, a first lower cross rod 43, and a first standing rod 44 connected in sequence. A top end of the first standing rod 44 comprises a first connecting shaft 45. The first vertical rod 42 is rotatably connected to the bracket 30 so that a corresponding one of the two front legs 40 can be rotated to be folded and unfolded. A bottom surface of the front bench board 20 is symmetrically disposed with two first sliding grooves 21. Each of the two first sliding grooves 21 is arc-shaped, and the first connecting shaft 45 of each of the two front legs 40 is slidably disposed in a corresponding one of the two first sliding grooves 21.

In an unfolded state, the two front legs 40 are outwardly unfolded, the front table board 10 and the front bench board 20 are horizontally placed, and the first connecting shaft 45 of each of the two front legs 40 slides to an outer end of the corresponding one of the two first sliding grooves 21. The first connecting shaft 45 of each of the two front legs 40 supports the front bench board 20, and at the same time, the first upper cross rod 41 of each of the two front legs 40 supports the front table board 10.

In a folded state, the two front legs 40 are inwardly folded, the first connecting shaft 45 of each of the two front legs 40 slides to an inner end of the corresponding one of the two first sliding grooves 21 so that the first connecting shaft 45 of each of the two front legs 40 rotatably connects to the front bench board 20 and the front bench board 20 can be turned down to a vertical position. At the same time, the first upper cross rod 41 of each of the two front legs 40 provides space to the front table board 10 so that the front table board 10 can be turned down to the vertical position. A straight line disposed with the first connecting shaft 45 is parallel to a rotation axis of the front table board 10.

The front bench board 20 comprises a first plastic panel 22 and a first bottom frame 24. The first bottom frame 24 is disposed along a periphery of a bottom surface of the first plastic panel 22. The first bottom frame 24 of the front bench board 20 comprises two first arc-shaped stopping rods 26 corresponding to the first connecting shaft 45 of each of the two front legs 40. The two first arc-shaped stopping rods 26 are configured to limit two ends of the corresponding one of the first connecting shafts 45 on a sliding track of the first connecting shaft 45 of the corresponding one of the two front legs 40. The two first arc-shaped stopping rods 26 and the first plastic panel 22 define the corresponding one of the two first sliding grooves 21. That is, the two first arc-shaped stopping rods 26 are arranged along edges of the corresponding one of the two first sliding grooves 21.

This embodiment further comprises a rear table board 50, a rear bench board 60, and two rear legs 70. A structure of the rear table board 50 is the same as the structure of the front table board 10. A structure of the rear bench board 60 is the same as the structure of the front bench board 20. A structure of the two rear legs 70 is the same as the structure of the two front legs 40.

Similarly, the two rear legs 70 are disposed on left and right sides of the bracket 30, and the rear table board 50 is pivotally connected to the bracket 30 and is configured to be rotated relative to the bracket 30. The rear leg 70 comprises a second upper cross rod 71, a second vertical rod 72, a second lower cross rod 73, and a second standing rod 74 connected in sequence. A top end of the second standing rod 74 comprises a second connecting shaft 75. The second vertical rod 72 is rotatably connected to the bracket 30 so that a corresponding one of the two rear legs 70 can be rotated to be folded and unfolded. A bottom surface of the rear bench board 60 is symmetrically disposed with two second sliding grooves 61. Each of the two second sliding grooves 61 is arc-shaped, and the second connecting shaft 75 of each of the two rear legs 70 is slidably disposed in a corresponding one of the two second sliding grooves 61.

In an unfolded state, the rear table board 50 and the rear bench board 60 are horizontally placed, and the second connecting shaft 75 of each of the two rear legs 70 slides to an outer end of the corresponding one of the two second sliding grooves 61. The second connecting shaft 75 of each of the two front legs 40 supports the rear bench board 60, and at the same time, the second upper cross rod 71 of each of the two rear legs 70 supports the rear table board 50.

In a folded state, the second connecting shaft 75 of each of the two rear legs 70 slides to an inner end of the corresponding one of the two second sliding grooves 61 so that the second connecting shaft 75 of each of the two rear legs 70 rotatably connects to the rear bench board 60 and the rear bench board 60 can be turned down to a vertical position. The second upper cross rod 71 of each of the two rear legs 70 provides space to the rear table board 50 so that the rear table board 50 can be turned down to the vertical position.

The rear bench board 60 comprises a second plastic panel 62 and a second bottom frame 64. The second bottom frame 64 of the rear bench board 60 comprises two second arc-shaped stopping rods 66 corresponding to the second connecting shaft 75 of each of the two rear legs 70. The two second arc-shaped stopping rods 66 are configured to limit two ends of the corresponding one of the second connecting shafts 75 on a sliding track of the second connecting shaft 75 of the corresponding one of the two rear legs 70. The two second arc-shaped stopping rods 66 and the second plastic panel 62 define the corresponding one of the two second sliding grooves 61.

In the folded state, the two front legs 40 and the two rear legs 70 are folded together, the first connecting shaft 45 is parallel to the rotation axis of the front table board 10. Therefore, the front table board 10 and the front bench board 20 are in a vertical plane and vertically (i.e., up and down) adjacent to each other. The second connecting shaft 75 is parallel to the rotation axis of the rear table board 50. Therefore, the rear table board 50 and the rear bench board 60 are in a vertical plane and vertically adjacent to each other.

The bracket 30 comprises two side rods 32 and a link rod 34 connecting the two side rods 32. Each of the two front legs 40 and each of the two rear legs 70 are rotatably connected to a corresponding one of the two side rods 32. A top end of each of the two side rods 32 respectively comprises a connecting board 31. A front end of the connecting board 31 is pivotally connected to a corresponding side of the front table board 10, and a rear end of the connecting board 31 is pivotally connected to a corresponding side of the rear table board 50. A middle part of a top surface of the connecting board 31 extends downwardly, which can provide space for the front table board 10 and the rear table board 50. Each of two sides of each of the two side rods 32 comprise a shaft sleeve 36 configured to surround the first vertical rod 42 of the corresponding one of the two front legs 40 or the second vertical rod 72 of the corresponding one of the two rear legs 70. The link rod 34 is connected to an upper end of each of the two side rods 32. When the front table board 10 and the rear table board 50 are placed horizontally, the front table board 10 and the rear table board 50 abut the link rod 34.

Figure 3:
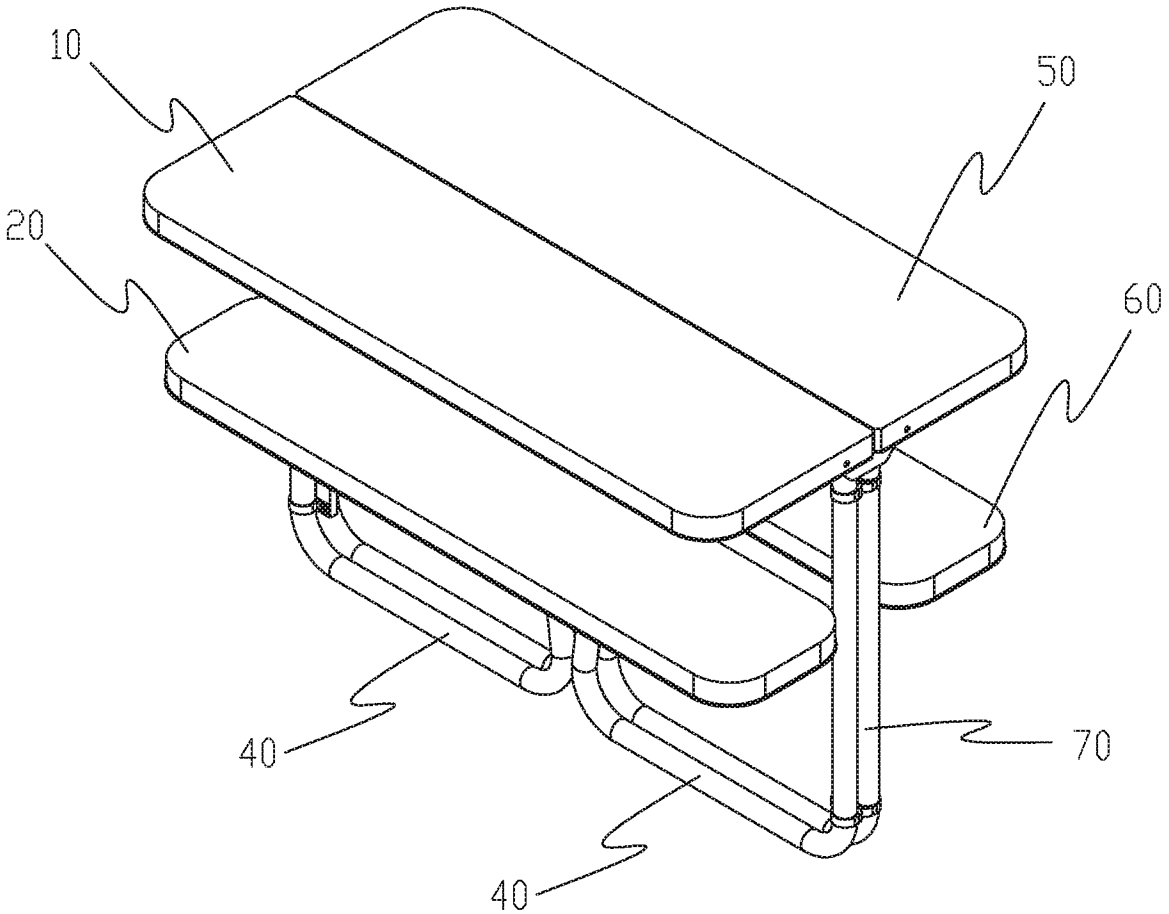
FIG. 3 illustrates a schematic view of the folding integrated table and bench of Embodiment 1 of the present disclosure when two front legs and two rear legs are folded.
Figure 4:
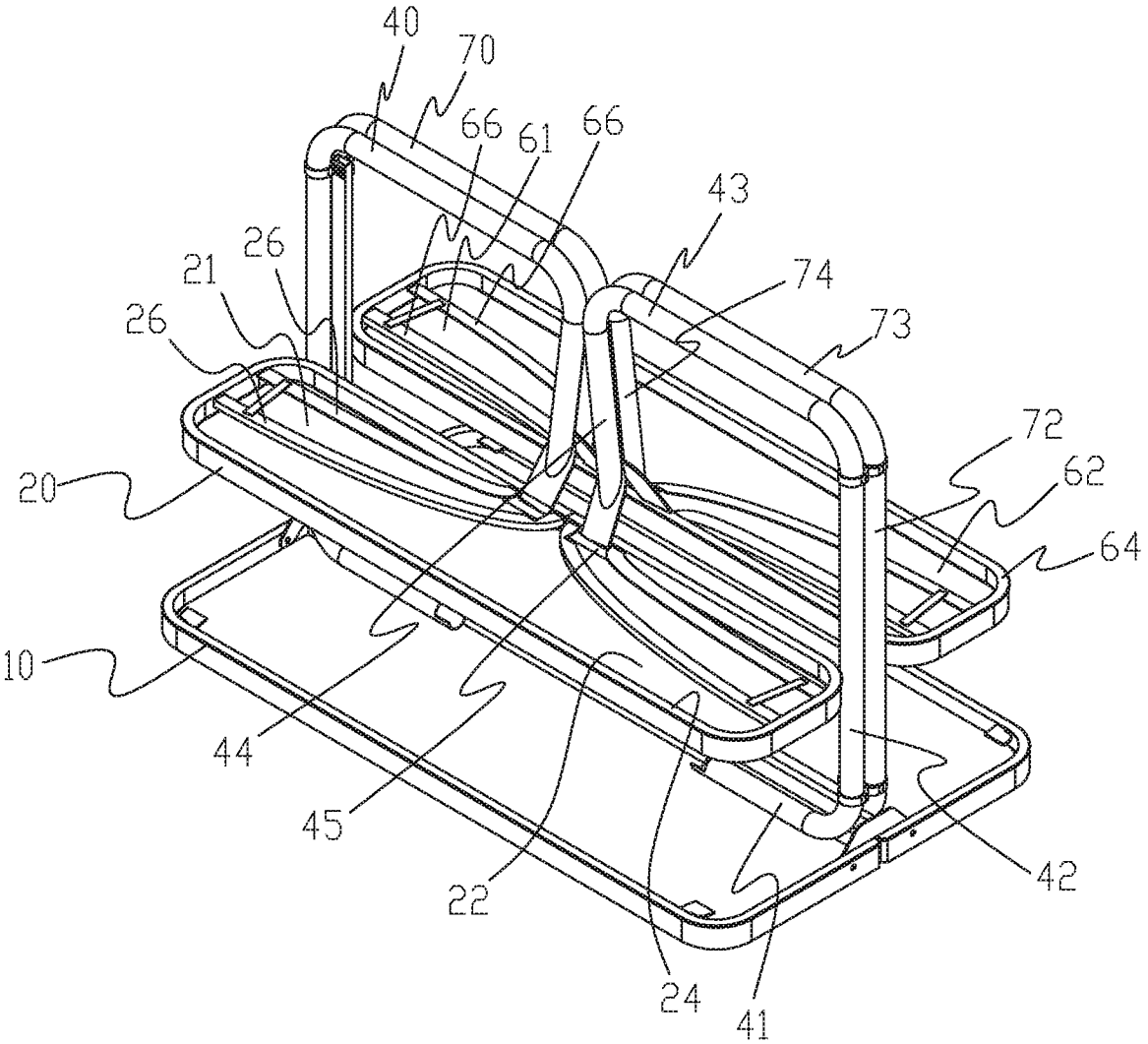
FIG. 4 illustrates another schematic view of the folding integrated table and bench of Embodiment 1 of the present disclosure when the two front legs and the two rear legs are folded.
Figure 5:
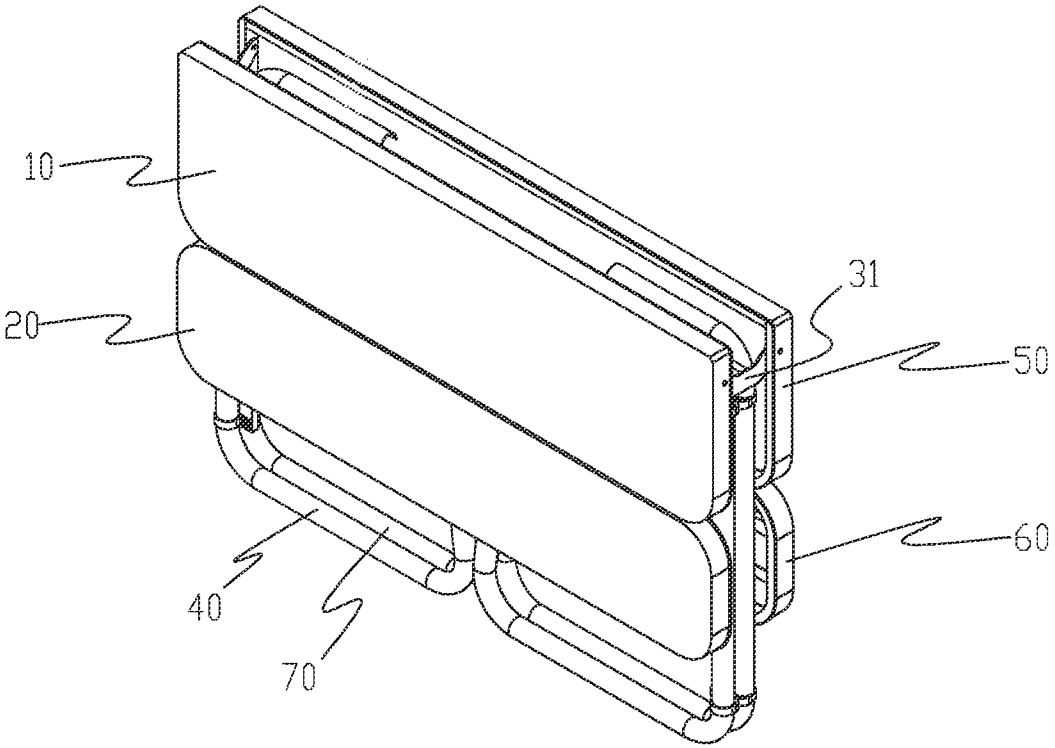
FIG. 5 illustrates a schematic view of the folding integrated table and bench of Embodiment 1 of the present disclosure in the folded state.
Figure 6:
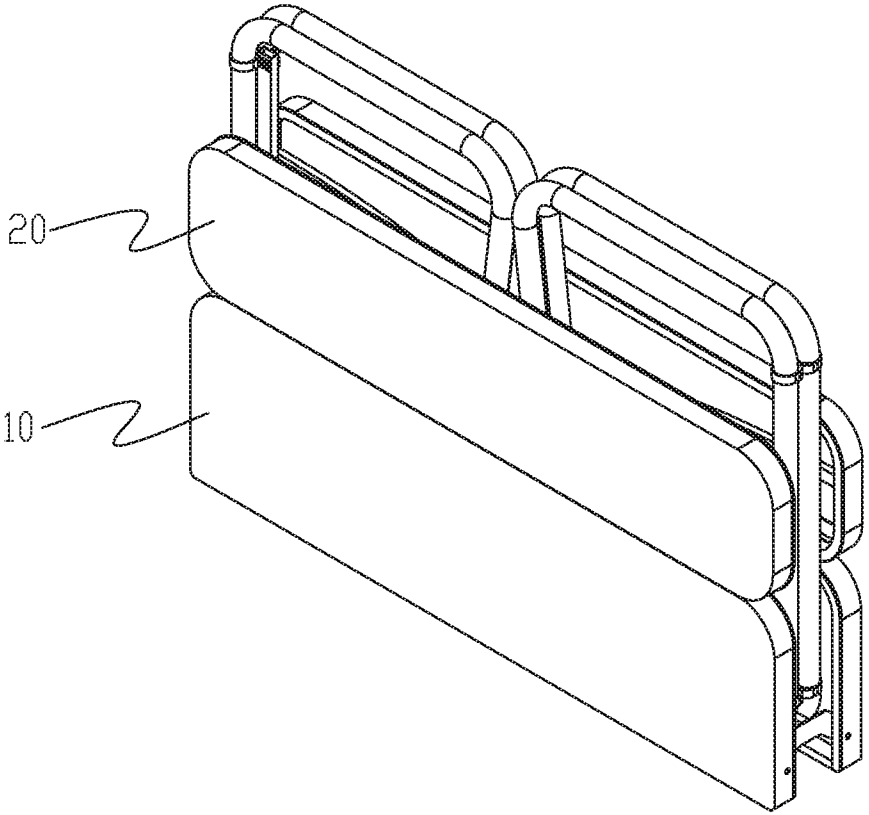
FIG. 6 illustrates another schematic view of the folding integrated table and bench of Embodiment 1 of the present disclosure in the folded state.

Referring to FIG. 3 and FIG. 4, after the two front legs 40 and the two rear legs 70 are folded, the front bench board 20 is moved in parallel until the front bench board 20 is below the front table board 10, the rear bench board 60 is moved in parallel until the rear bench board 60 is below the rear table board 50, and then the front bench board 20, the front table board 10, the rear bench board 60, and the rear table board 50 can be folded.

Figure 7:
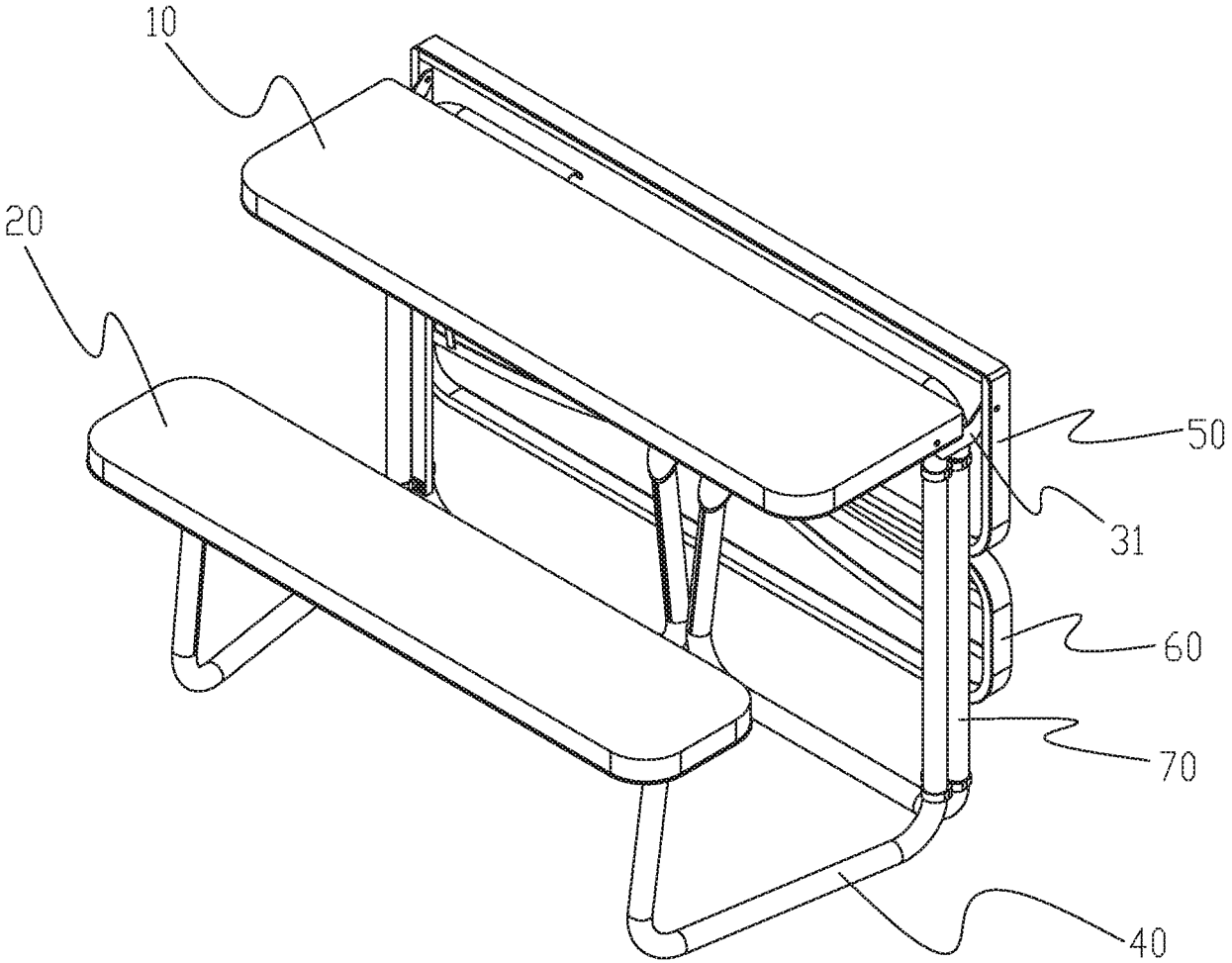
FIG. 7 illustrates a schematic view of the folding integrated table and bench of Embodiment 1 of the present disclosure when the two rear legs, a rear table board, and a rear bench board are folded.
Figure 8:
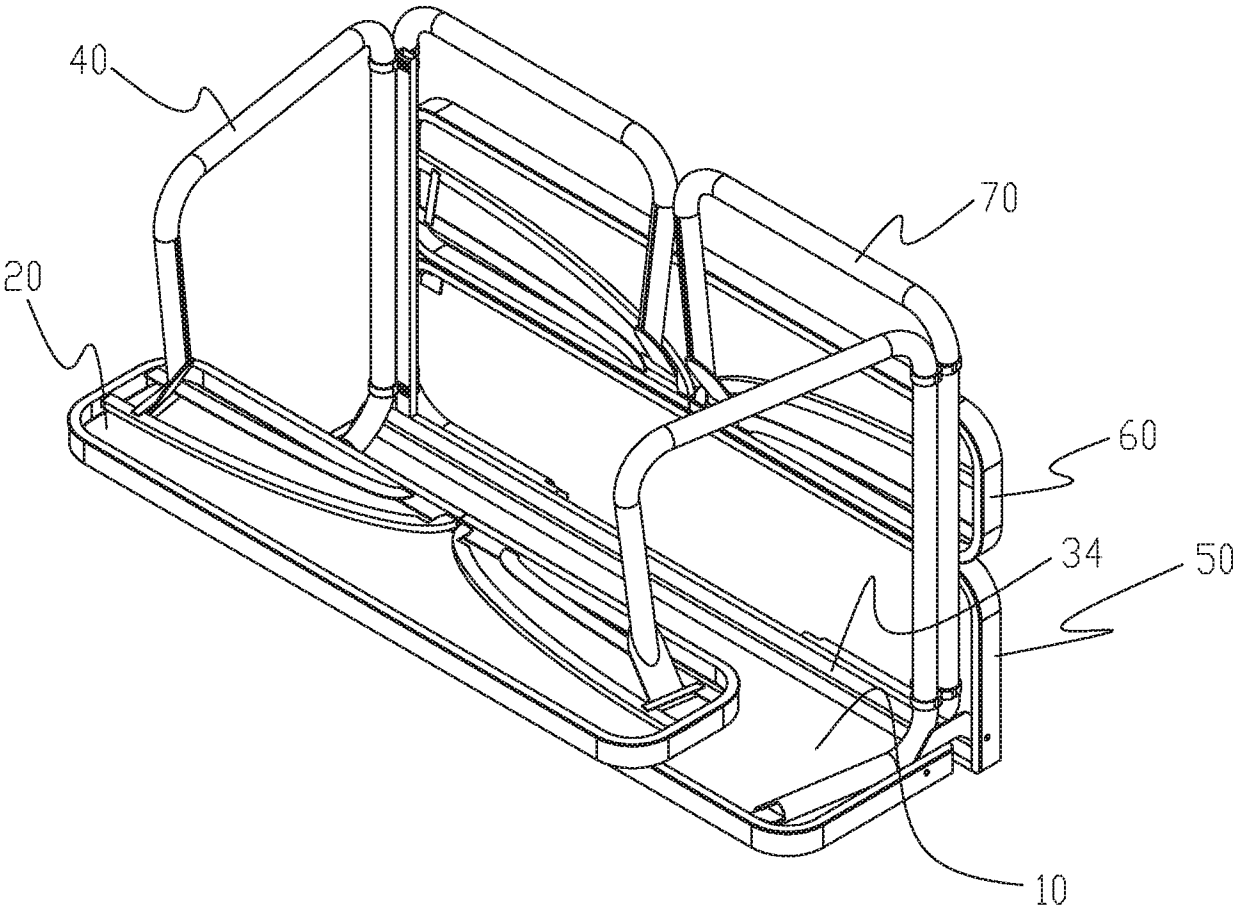
FIG. 8 illustrates another schematic view of the folding integrated table and bench of Embodiment 1 of the present disclosure when the two rear legs, the rear table board, and the rear bench board are folded.

Referring to FIG. 7 and FIG. 8, when in use, it is also possible to unfold the two front legs 40 while keeping the two rear legs 70 from being unfolded. In this way, the front bench board 20 and the front table board 10 can be unfolded while the rear bench board 60 and the rear table board 50 are still in a folded state.

Although the present disclosure has been described with reference to the preferred embodiments, it will be apparent to those skilled in the art that various modifications and variations can be made in the present disclosure without departing from the spirit or scope of the invention. Thus, it is intended that the present disclosure cover the modifications and variations of this invention provided they come within the scope of the appended claims and their equivalents.

What is claimed is:

1. A folding integrated table and bench, comprising:
- a front table board,
- a front bench board,
- a bracket, and
- two front legs, wherein:
  - the two front legs are symmetrically disposed on a left side and a right side of the bracket,
  - the front table board is pivotally connected to the bracket and is configured to be rotated relative to the bracket,
  - each of the two front legs comprises a first upper cross rod, a first vertical rod, a first lower cross rod, and a first standing rod connected in sequence,
  - a top end of the first standing rod comprises a first connecting shaft,
  - the first vertical rod is rotatably connected to the bracket so that each of the two front legs is configured to be rotated to be folded and unfolded,
  - a bottom surface of the front bench board is symmetrically disposed with two first sliding grooves,
  - each of the two first sliding grooves is arc-shaped,
  - the first connecting shaft of each of the two front legs is slidably disposed in a corresponding one of the two first sliding grooves,
  - when the folding integrated table and bench is in an unfolded state:
    - the front table board and the front bench board are horizontally placed,
    - the first connecting shaft of each of the two front legs is disposed at an outer end of the corresponding one of the two first sliding grooves,
    - the first connecting shaft of each of the two front legs supports the front bench board, and
    - the first upper cross rod of each of the two front legs supports the front table board, and
  - when the folding integrated table and bench is in a folded state:
    - the first connecting shaft of each of the two front legs is disposed at an inner end of the corresponding one of the two first sliding grooves so that the first connecting shaft of each of the two front legs is rotatably connected to the front bench board,
    - the front bench board is configured to be turned down to a vertical position,
    - the first upper cross rod of each of the two front legs provides space to the front table board, and
    - the front table board is configured to be turned down to the vertical position.

2. The folding integrated table and bench according to claim 1, wherein:
- the front bench board comprises a first plastic panel and a first bottom frame,
- the first bottom frame comprises two first arc-shaped stopping rods corresponding to the first connecting shaft of each of the two front legs,
- the two first arc-shaped stopping rods are configured to limit two ends of a corresponding one of the first connecting shafts on a sliding track of the first connecting shaft of a corresponding one of the two front legs, and
- the two first arc-shaped stopping rods and the first plastic panel define the corresponding one of the two first sliding grooves.

3. The folding integrated table and bench according to claim 1, comprising:
- a rear table board,
- a rear bench board, and
- two rear legs, wherein:
  - the two rear legs are symmetrically disposed on the left side and the right side of the bracket,
  - the rear table board is pivotally connected to the bracket and is configured to be rotated relative to the bracket,
  - each of the two rear legs comprises a second upper cross rod, a second vertical rod, a second lower cross rod, and a second standing rod connected in sequence,
  - a top end of the second standing rod comprises a second connecting shaft,
  - the second vertical rod is rotatably connected to the bracket so that each of the two rear legs is configured to be rotated to be folded and unfolded,
  - a bottom surface of the rear bench board is symmetrically disposed with two second sliding grooves,
  - each of the two second sliding grooves is arc-shaped,
  - the second connecting shaft of each of the two rear legs is slidably disposed in a corresponding one of the two second sliding grooves,
  - when the folding integrated table and bench is in the unfolded state:
    - the rear table board and the rear bench board are horizontally placed,
    - the second connecting shaft of each of the two rear legs is disposed at an outer end of the corresponding one of the two second sliding grooves,
    - the second connecting shaft of each of the two rear legs supports the rear bench board, and
    - the second upper cross rod of each of the two rear legs supports the rear table board, and when the folding integrated table and bench is in the folded state:

the second connecting shaft of each of the two rear legs is disposed at an inner end of the corresponding one of the two second sliding grooves so that the second connecting shaft of each of the two rear legs is rotatably connected to the rear bench board, the rear bench board is configured to be turned down to the vertical position, the second upper cross rod of each of the two rear legs provides space to the rear table board, and the rear table board is configured to be turned down to the vertical position.

4. The folding integrated table and bench according to claim 3, wherein:

the rear bench board comprises a second plastic panel and a second bottom frame, the second bottom frame comprises two second arc-shaped stopping rods corresponding to the second connecting shaft of each of the two rear legs, the two second arc-shaped stopping rods are configured to limit two ends of a corresponding one of the second connecting shafts on a sliding track of the second connecting shaft of a corresponding one of the two rear legs, and the two second arc-shaped stopping rods and the second plastic panel define the corresponding one of the two second sliding grooves.

5. The folding integrated table and bench according to claim 3, wherein, when the folding integrated table and bench is in the folded state:

the front table board and the front bench board are in a first vertical plane and vertically adjacent to each other, and the rear table board and the rear bench board are in a second vertical plane and vertically adjacent to each other.

6. The folding integrated table and bench according to claim 3, wherein:

the bracket comprises two side rods and a link rod connecting the two side rods, each of the two front legs and each of the two rear legs are rotatably connected to a corresponding one of the two side rods, a top end of each of the two side rods respectively comprises a connecting board, a front end of the connecting board is pivotally connected to a corresponding side of the front table board, and a rear end of the connecting board is pivotally connected to a corresponding side of the rear table board.

7. The folding integrated table and bench according to claim 6, wherein:

the link rod is connected to an upper end of each of the two side rods, and when the front table board and the rear table board are placed horizontally, the front table board and the rear table board abut the link rod.

8. The folding integrated table and bench according to claim 6, wherein each of two sides of each of the two side rods comprises a shaft sleeve configured to surround the first vertical rod of a corresponding one of the two front legs or the second vertical rod of a corresponding one of the two rear legs.

* * * * *